US008869945B2

(12) United States Patent
Härkönen et al.

(10) Patent No.: US 8,869,945 B2
(45) Date of Patent: Oct. 28, 2014

(54) SUPPLEMENTAL ELEVATOR SAFETY SYSTEM

(75) Inventors: Ari Härkönen, Riihimäki (FI); Sakari Korvenranta, Hyvinkää (FI); Ari Kattainen, Hyvinkää (FI); Timo Syrman, Hyvinkää (FI); Hannu Ahrnberg, Hyvinkää (FI); Risto Jokinen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/372,486

(22) Filed: Feb. 17, 2009

(65) Prior Publication Data

US 2009/0178889 A1 Jul. 16, 2009

Related U.S. Application Data

(63) Continuation of application No. PCT/FI2007/000196, filed on Aug. 6, 2007.

(30) Foreign Application Priority Data

Aug. 14, 2006 (FI) ..... 20060727

(51) Int. Cl.

| | |
|---|---|
| ***B66B 1/40*** | (2006.01) |
| ***B66B 1/32*** | (2006.01) |
| ***B66B 1/28*** | (2006.01) |
| *B66B 1/50* | (2006.01) |
| *B66B 1/44* | (2006.01) |

(52) U.S. Cl.

CPC ... *B66B 1/28* (2013.01); *B66B 1/32* (2013.01); *B66B 1/44* (2013.01)

USPC ..... 187/288; 187/291; 187/393; 187/394

(58) Field of Classification Search

CPC ..... B66B 1/40; B66B 1/44; B66B 1/32; B66B 1/28

USPC ..... 187/291, 293, 305, 351, 394, 288

See application file for complete search history.

(56) References Cited

U.S. PATENT DOCUMENTS 4,034,856 A 7/1977 Wehrli, III et al.
4,880,082 A * 11/1989 Kahkipuro et al. ..... 187/394

(Continued)

FOREIGN PATENT DOCUMENTS

EP 1 431 229 A1 6/2004
WO WO 2006/010781 A2 2/2006

(Continued)

OTHER PUBLICATIONS

XP003025570, "Lift Cage Drive Mechanism—Selects Motor Winding and Brake Operation to Suit Cage Load and Travel Direction," Thomson, Dec. 22, 1976 (1 page).

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

The invention relates to a safety arrangement of an elevator system and to a method for ensuring safety in an elevator system. The safety arrangement comprises at least one mechanical stopping appliance and the control of the safety arrangement comprises at least one limit value that sets the speed, deceleration or permitted vertical distance from the door zone of the elevator car. In the method for ensuring safety in an elevator system at least one mechanical stopping appliance is fitted to the safety arrangement of the elevator system and at least one limit value that sets the speed, deceleration or permitted vertical distance from the door zone of the elevator car is set for the control of the safety arrangement.

5 Claims, 3 Drawing Sheets

(56) References Cited

U.S. PATENT DOCUMENTS

| | | | | |
|---|---|---|---|---|
| 4,923,055 | A * | 5/1990 | Holland | 187/287 |
| 4,977,982 | A * | 12/1990 | Bialy et al. | 187/350 |
| 5,159,162 | A * | 10/1992 | Tatino | 187/280 |
| 5,266,757 | A * | 11/1993 | Krapek et al. | 187/295 |
| 5,869,794 | A | 2/1999 | Spiess | |
| 2004/0178024 | A1 | 9/2004 | Deplazes et al. | |
| 2004/0200671 | A1 * | 10/2004 | Kugiya et al. | 187/293 |
| 2004/0238289 | A1 * | 12/2004 | Martin | 187/301 |
| 2005/0269163 | A1 * | 12/2005 | Angst | 187/287 |
| 2006/0027424 | A1 * | 2/2006 | Jahkonen | 187/293 |
| 2006/0124399 | A1 * | 6/2006 | Kugiya et al. | 187/295 |

FOREIGN PATENT DOCUMENTS

| | | | | |
|---|---|---|---|---|
| WO | WO 2006010784 | A2 * | 2/2006 | B66B 11/08 |
| WO | WO-2006/082275 | A2 | 8/2006 | |

* cited by examiner

--Prior Art--

SUPPLEMENTAL ELEVATOR SAFETY SYSTEM

This application is a Continuation of copending PCT International Application No. PCT/FI2007/000196 filed on Aug. 6, 2007, which designated the United States, and on which priority is claimed under 35 U.S.C. §120. This application also claims priority under 35 U.S.C. §119(a) on Patent Application No(s). 20060727 filed in Finland on Aug. 14, 2006, all of which are hereby expressly incorporated by reference into the present application.

FIELD OF THE INVENTION

The present invention relates to a safety system for an elevator.

PRIOR ART

In elevator systems, it is important to maximize the safety of passengers. The elevator car may not move outside the landing zone when the doors are open, the elevator car may not drop freely at any phase, nor may its movement reach uncontrolled acceleration or uncontrolled deceleration. For this reason elevator appliances contain numerous safety and stopping devices, which take care of the stopping of the elevator car in both normal and fault situations.

The control system of the elevator handles the driving of the elevator from floor to floor. During normal drive, the control system of the elevator ensures that, for example, the speed of the elevator decreases and that the elevator stops at the right point of the floor. The control system stops the elevator smoothly at the terminal floor. If normal stopping of the elevator by means of the control system does not work, Normal Terminal Slowdown (NTS) handles the smooth stopping of the elevator at the terminal floor.

If Normal Terminal Slowdown (NTS) does not succeed in stopping the elevator when it arrives at the end of the shaft, ETSL (Emergency Terminal Speed Limiting) stops the elevator by using the machinery brake. The machinery brake is an electromechanical brake, which is generally arranged to connect to the traction sheave of the elevator. If the deceleration of the elevator is not adequate, ETSL can still use the brake of the elevator car or the wedge brake, i.e. the safety gear, for stopping.

FIG. 1 presents the operation of the safety devices of a modern elevator system. Graph 11 illustrates the travel of the elevator as a function of distance and speed.

A mechanical overspeed governor (OSG) can be used as a safety device. The overspeed governor monitors the speed of the elevator car in the elevator shaft and if the speed of the elevator car exceeds a certain pre-set limit value (, for example, 6 m/s), the overspeed governor disconnects the safety circuit of the elevator, in which case the machinery brake goes on (area 12). The elevator contains a safety circuit, which is cut if any of the switches that are connected to it opens. If the overspeed still increases from the previous, the overspeed governor uses the safety gear (area 16) that is in connection with the elevator car. The wedge of the safety gear grips the guide rails of the elevator and prevents the elevator car from sliding. In other words, if the ropes or rope suspensions fail and the elevator car starts to drop freely, the safety gear wedges and grips.

Overspeed can also be monitored electrically. For example, a solution is known from publication WO 00/39015, in which an electronic overspeed monitoring appliance receives a signal indicating the speed of the car, compares the speed of the car to the speed limit data stored in the memory of the monitoring appliance, and, if necessary, produces an activation signal, by means of which the brakes of the elevator can be engaged.

Near the end of the elevator shaft is a final limit switch. The position of the final limit switch is marked x1 in FIG. 1. If the elevator has not stopped before the final limit switch, the safety circuit of the elevator is again cut and the brake of the elevator operates. The final limit switch uses the machinery brake to stop the elevator car (area 12) if the elevator goes, for example, 100 mm past the terminal station.

If the elevator continues onwards a few centimeters from the final limit switch, the car (or correspondingly the counterweight) collides with the buffer 13, which yields and finally stops the elevator. After the buffer there is still an empty space 14, after which the concrete end structure 15 of the shaft is encountered. FIG. 1 depicts the shaft structure of an elevator system with a counterweight. In an elevator without a counterweight, the buffer structure of the top end of the shaft can be lighter than the one below, because uncontrolled movement can only occur downwards.

Even if the normal control system fails, full-length buffers have a stroke length equal to the amount that, in principle, is safe to drive onto the buffers at full speed, nor does the acceleration inside the car go over the permitted limit before the elevator car stops. Typically 1 g is the kind of acceleration/deceleration that is set in the safety regulations as bearable by a person.

There are also elevator systems in which so-called "reduced stroke buffers" are used. In this case an electrical safety connection is used as an aid in stopping the car. A switch is installed at a certain distance from the end of the shaft, the speed limit of which is, for example, 90% of the nominal speed. A second switch is installed slightly closer to the end of the shaft, the speed limit of which is, for example, 60% of the nominal speed. If the speed is over that permitted at the point of the switch, the safety circuit is again cut and the machinery brake stops the elevator car. If the overspeed still increases from the previous, the safety system of the elevator uses the safety gear in connection with the elevator car to stop the car.

The authorities of different countries have different regulations concerning the safety of elevators. The basic principle is that the elevator must contain the kind of safety system that is able to stop the elevator in a fault situation. For example, according to the elevator directive 95/16/EC issued by the European Union, an elevator must contain an overspeed governor as well as a speed monitoring system. The elevator may not reach uncontrolled acceleration or uncontrolled deceleration. Furthermore, the situation in which the elevator car starts to slide out of the landing zone when the doors are open, owing, for example, to rope slipping or a fault situation in the machinery brake, must be avoided.

OBJECTS OF THE INVENTION

An object of the present invention is to present a new kind of method for ensuring safety in an elevator system, and an elevator system that is safe and reliable. In particular, the purpose of the invention is to disclose a method for ensuring safety in an elevator system without a counterweight, by means of which it is possible both to prevent unintended movement of the elevator car in the floor zone and an overspeed situation of the elevator car, as well as to ensure controlled stopping of the elevator, and an elevator system without a counterweight in which stopping of the elevator car is ensured when prior art safety equipment malfunctions.

SUMMARY FEATURES OF THE INVENTION

The inventive content may be several separate inventions, especially if the invention is considered in the light of expressions or implicit sub-tasks or from the point of view of advantages or categories of advantages achieved. In this case, some of the attributes may be superfluous from the point of view of separate inventive concepts. The features of the various embodiments can be applied within the scope of the basic inventive concept in conjunction with other embodiments. Furthermore the features that are presented in conjunction with the method according to the invention can be applied in an elevator system according to the invention, and vice versa.

The elevator system includes a safety arrangement as well as the control of the safety arrangement. The safety arrangement includes at least one mechanical stopping appliance and the control of the safety arrangement includes at least one limit value that sets the speed, deceleration or permitted vertical distance from the door zone of the elevator car. The control of the safety arrangement also includes the measurement of time, and the limit value of the control of the aforementioned safety arrangement is defined as a function of time.

In one elevator system the limit value of the control of the aforementioned safety arrangement is fitted to activate when the operating mode of the elevator system changes.

In one elevator system the safety arrangement includes means for receiving information about the direction of movement, speed and/or deceleration of the elevator car, the status of the safety circuit of the elevator, the status of the machinery brake of the elevator and/or the positioning of the elevator car in the door zone, and monitoring means for ensuring that the vertical distance from the door zone as well as the speed and/or deceleration of the elevator car remain in the range defined by the limit value, and means to control at least one stopping appliance if the vertical distance from the door zone, speed and/or deceleration of the elevator car is outside the permitted range set by the limit value. The safety arrangement further comprises means for setting the operating mode of the elevator system utilizing the information about the direction of movement, speed and/or deceleration of the elevator car, preliminary information about arrival of the elevator in the door zone extrapolated from the status of the safety circuit, information about the status of the machinery brake of the elevator and/or the positioning of the elevator car in the door zone. A limit value, which sets the limit for the permitted minimum deceleration of the elevator car, is set for at least one operating mode of the elevator system.

The safety arrangement can also comprise means for receiving information about the service drive mode of the elevator and means to set the operating mode of the elevator system utilizing the information about service drive mode, and/or means for measuring time and for storing the time of the switching of the operating mode of the elevator system. Preferably a limit value of the speed and/or minimum deceleration of the elevator car set for at least one operating mode of the elevator system is defined as a function of time, and a limit value, which sets a limit for the permitted maximum speed of the elevator car, is set for at least one operating mode of the elevator system. A first limit value, which sets the limit for the permitted speed of the elevator car, and at least one second limit value, which sets the limit for the vertical distance of the elevator car from the door zone, can be set for at least one operating mode of the elevator system.

The elevator system also preferably includes measuring means for constant measuring the direction of movement, the speed and/or the deceleration of the elevator car. The means for controlling the stopping appliance can comprise a control switch. There are further means for testing the operation of the control switch. In one preferred embodiment the monitoring means are integrated as a part of the control system of the elevator, and the safety arrangement is fitted into the elevator system as supplementary safety, in addition to the machinery brake, the mechanical overspeed monitoring and the limit switches.

In the method for ensuring safety in an elevator system at least one mechanical stopping appliance is fitted to the safety arrangement of the elevator system and at least one limit value that sets the speed, deceleration or permitted vertical distance from the door zone of the elevator car is set for the control of the safety arrangement. In the method the passage of time is measured and at least one limit value of the control of the aforementioned safety arrangement is set as a variable function with respect to time.

In one method according to the invention at least one limit value of the control of the safety arrangement is activated when the operating mode of the elevator system changes.

In one method according to the invention the vertical distance of the elevator car from the door zone, the direction of movement, speed and/or deceleration of the elevator car, the status of the safety circuit of the elevator, the status of the machinery brake of the elevator and/or the positioning of the elevator car in the door zone, is checked. The vertical distance of the elevator car from the door zone as well as the speed and/or deceleration of the elevator car being within the permitted range defined by the limit values are monitored. If one of the monitored values receives a value outside the permitted range, at least one stopping appliance is controlled.

The operating mode of the elevator system is set utilizing the information about the direction of movement, the vertical distance from the door zone, the speed and/or the deceleration of the elevator car, preliminary information about arrival of the elevator in the door zone extrapolated from the status of the safety circuit, information about the status of the machinery brake of the elevator and/or the positioning of the elevator car in the door zone, and a limit value, which sets the limit for the minimum deceleration of the elevator car. It is also possible to receive information about the service drive mode of the elevator and to set the operating mode of the elevator system utilizing the information about service drive mode. In one preferred embodiment the moment in time when the operating mode of the elevator system changes is stored in memory, the passage of time is measured, and the vertical distance of the elevator car from the door zone as well as the speed and/or deceleration of the elevator car are monitored, at least one limit value is defined as a function of time. In at least one operating mode the speed of the elevator car is monitored to remain below a certain maximum speed. In at least one operating mode of the elevator system, the speed and position of the elevator car are monitored to ensure that the speed remains below the permitted speed limit and the position of the car remains a permitted distance from the door zone. When any measured quantity falls outside the predetermined limit, a brake is activated. Preferably the operation of the control switch of the stopping appliance is tested according to the method at regular intervals.

In the following the elevator system and the method of the invention are referred to jointly as the solution according to the invention.

ADVANTAGES OF THE INVENTION

With the solution according to the invention it is possible to avoid hazardous situations produced by undesired movement caused by rope slip or defective machinery brakes, and it is further possible to ensure that the speed of the elevator remains controlled, for example, in a situation in which dynamic braking does not succeed. It is further possible to ensure success of an emergency stop of the elevator in elevators without a counterweight. The safety arrangement incorporated in the elevator system according to the invention can easily be applied for use in conjunction with prior art safety devices, in which case the safety arrangement presented in the invention improves the safety level of the elevator system with few extra components, and it is possible to utilize the stopping appliances and measuring signals otherwise incorporated in the elevator system.

BRIEF DESCRIPTION OF THE DRAWINGS

In the following, the invention will be described in more detail by the aid of one of its embodiments with reference to the attached drawings, wherein.

The elevator system according to the invention comprises a safety arrangement as well as the control of the safety arrangement. Preferably the safety arrangement is used as a supplement to prior art safety devices, in which case the safety arrangement presented in the invention stops movement of the elevator car when the prior art safety devices accordingly do not operate in the desired manner for some reason.

The safety arrangement of the elevator system according to the invention comprises means for receiving and inspecting at least the direction of movement, speed and/or deceleration of the elevator car, the status of the machinery brake of the elevator, the status of the safety circuit of the elevator and the door zone information of the elevator. In elevators without counterweight the machinery brake is typically an asymmetrical brake, which is fitted to brake movement directed downwards with a greater force than movement directed upwards. The safety arrangement further comprises monitoring means, with which it is possible to monitor that the vertical distance of the elevator car from the door zone as well as the speed and/or deceleration of the elevator car remain within the permitted range defined by the limit values of movement, and means for setting the operating mode of the elevator system. According to the invention, by means of the safety arrangement the vertical distance of the elevator car from the door zone as well as the speed and/or deceleration of the elevator car staying within the boundaries of the limit value in certain operating modes of the elevator system are monitored. In different operating modes the movement can be compared to different limit values, and numerous limit values, which are monitored for non-exceedance of their boundaries, can also be connected to a certain operating mode. If the movement of the elevator car is not within the permitted range set by the limit value, at least one stopping appliance is controlled, with which the elevator car can be stopped.

An operating mode of an elevator system means a certain status in which the elevator system can be, the operating mode determined by the status of the safety devices and/or actuating devices of the elevator system and/or on the basis of the speed information and/or position information of the elevator car. In the safety arrangement the operating modes to be set do not need to correspond to the other operating modes set for the safety devices or control devices of the elevator system, although they can be the same. For example, the acceleration, uniform speed and braking statuses that are necessary for traffic control can from the viewpoint of the safety arrangement all belong to operating mode 10 "elevator driving".

Figure 2:
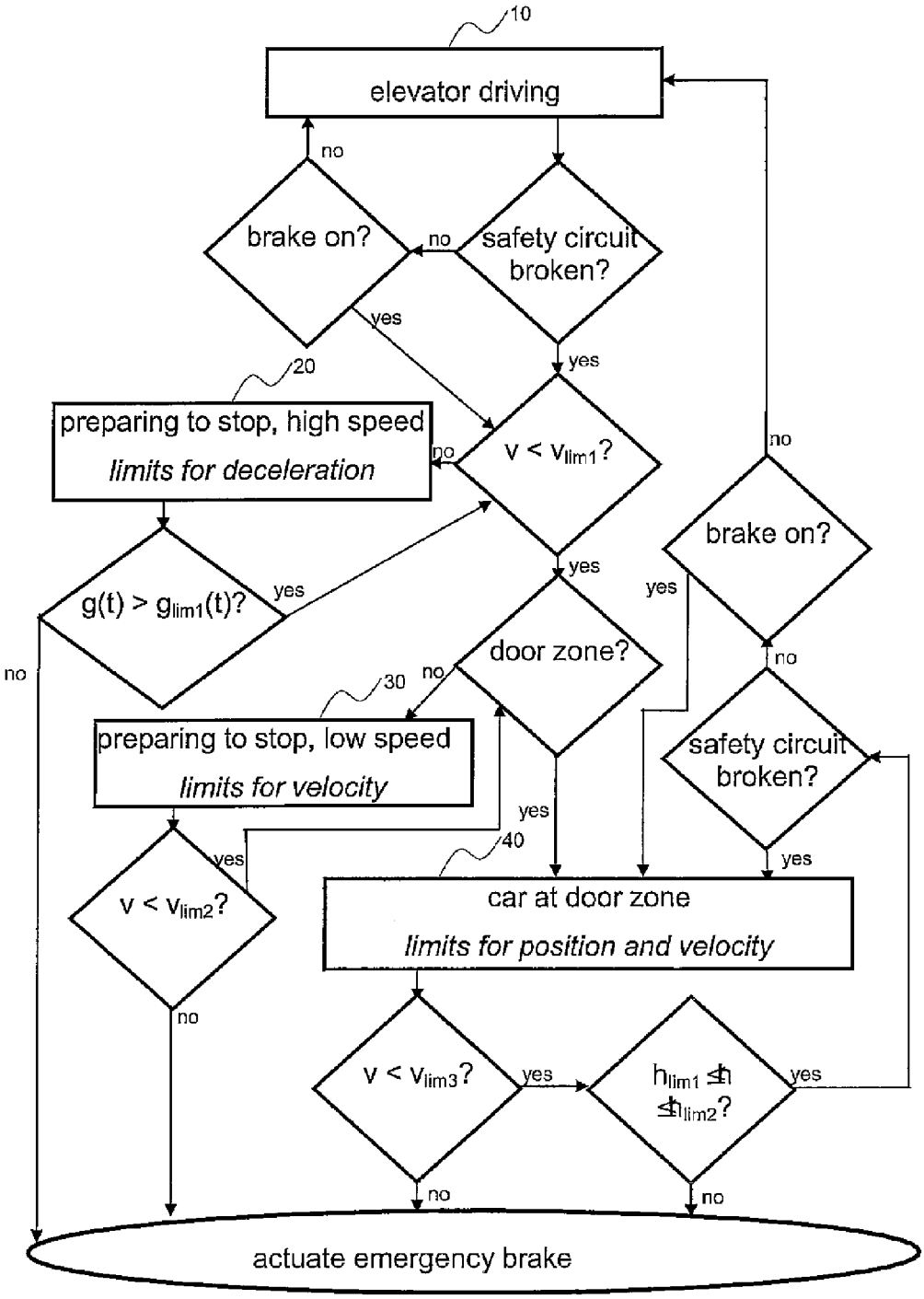
FIG. 2 presents a block diagram of the operating modes of the elevator system according to the invention and the switching between modes.

The operation of the safety arrangement is described in conjunction with the operating modes of the elevator system according to FIG. 2 and the method of the safety arrangement for setting the operating mode of the elevator system and for switching from one operating mode to another. When the invention is applied in an elevator system without a counterweight, in which the safety arrangement comprises means for setting four different operating modes. Different operating modes defined by the means of the safety arrangement, to which one or more supervisory limit values can be set, can also be more or less than this, and the invention is also suited for use also in elevator systems with a counterweight.

Figure 1:
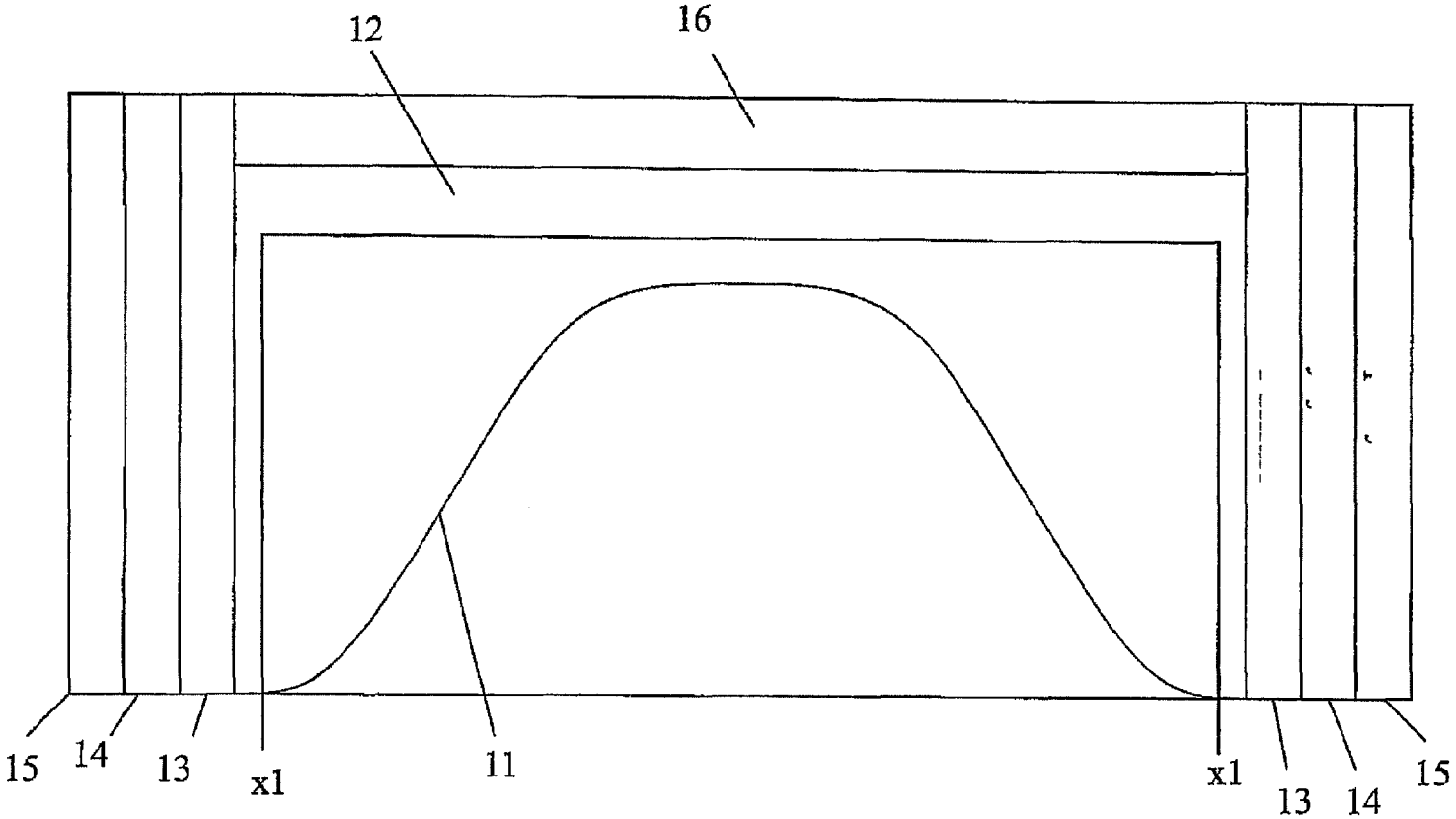
FIG. 1 presents the operation of one safety device according to the prior art.

FIG. 2 depicts the switching of an elevator system from one operating mode to another as a block diagram. Preferably a movement of the elevator car, such as speed, deceleration and/or position as a function of time, is constantly monitored irrespective of the operating mode of the elevator system, although it is also possible that the safety arrangement is fitted to activate the stopping appliance only in certain operating modes, to which a limit value of the motion is set, within which defined permitted range the movement of the elevator car must be. It is also possible that a limit value is set for all the operating modes of the elevator system, compliance with which is monitored and exceedance of the boundaries of a limit value activates a stopping appliance. For example, in the solution according to FIG. 2 the limit curve 11 presented in FIG. 1 could be used in operating mode 10 (elevator driving), i.e. during normal driving of the elevator, which describes the travel of the elevator in the elevator shaft as a function of speed and position, or the electrical safety arrangement according to the invention could be used to replace the mechanical overspeed governor, and a speed limit, which movement of the elevator car may in no circumstances exceed, could be set as the limit value for the mode 10.

In the solution according to FIG. 2, at least information about the status (on/off) of the machinery brake, the status (open/closed) of the safety circuit of the elevator, the door zones and the vertical distance of the elevator car from a door zone are monitored, in addition to the speed and deceleration of the elevator car. This information is preferably constantly monitored. On the basis of the information the operating mode of the elevator system is defined. The safety arrangement preferably also comprises means for measuring time and a memory, in which information about the moment the elevator system switches from one operating mode to another can be stored. The safety arrangement also comprises a memory in which the limit values related to each operating mode of the elevator system is stored.

Door zone information can be obtained, for example, by means of magnets fitted in the elevator shaft in connection with each landing and by means of inductive switches fitted to the elevator car or by means of other sensors suited to conveying door zone information. Information about the movement of the elevator car can be obtained, for example, with a speed sensor such as a pulse encoder or other applicable speed measuring or position measuring method connected to the elevator car, the overspeed governor, or the rope of the overspeed governor. The speed of the elevator car can be calculated from the position information or, when the point of departure is known, the position of the elevator car can be calculated by means of the speed. Further, by means of the speed information it is possible to calculate the acceleration/deceleration of the elevator car, and it is also possible that acceleration sensors for determining deceleration data are connected to the elevator car.

The safety arrangement can comprise means for receiving other information describing the status of the elevator system. For example, information about the status of the main contactor of the elevator, the stopping device, such as the switch of the OSG or other anti-creeping appliance and/or the relay controlling this, and/or about manual opening of the machinery brake of the elevator, about the load of the elevator car, or another switch or actuator connected to the elevator system, can be received and monitored, and these can be utilized in setting the operating mode of the elevator system. Further, it is possible to monitor and utilize other information in setting the operating mode, such as information about the speed reference of the elevator, service drive mode, inching mode or another command relating to control of the movements of the elevator.

In FIG. 2 the elevator system has four operating modes detected by the safety arrangement, for three of which a limit value is set, which sets the limits for permitted movement of the elevator car, within the boundaries of which the movement must remain, and if the movement exceeds the boundaries a stopping appliance is activated. The stopping appliance according to the invention can be, for example, a prior art anti-creeping device. It can be, for example, a mechanical catch, guide rail brake or rope brake, which locks directly against the hoisting ropes of the elevator. The stopping appliance can also be a rope brake, which locks the rope of the overspeed governor in its position, or an appliance that prevents or brakes rotation of the rope pulley of the overspeed governor, in which case when the elevator car moves a little distance downwards, the rope of the overspeed governor activates the safety gear of the elevator and thus prevents creeping of the elevator car downwards. The mechanism that stops the rope of the overspeed governor functions as the stopping appliance, which thus can be formed from, for example, a rope brake or the safety gear.

The safety arrangement checks the operating mode of the elevator system, preferably continuously, and when the operating mode of the elevator system changes, the safety arrangement switches to compare the movement of the elevator car to the limit value corresponding to the new operating mode. During normal driving 10 of the elevator (elevator driving) the status of the safety circuit and of the machinery brake is monitored. If the brake engages and the safety circuit opens, it is interpreted as the end of elevator driving. If there is no fault situation in the elevator system, the actual situation is one in which the elevator car is arriving at a landing. Before the elevator system is interpreted as having switched to mode 40 "car at door zone", the direction of movement and the speed of the elevator car are checked. The directions of the magnitudes presented in FIG. 2 are defined such that the positive direction of the speed v is downwards, and the deceleration g is positive when the elevator car moves downwards at a decelerating speed.

If the elevator car is moving downwards and the speed is more than the set limit speed $v_{lim1}$, the elevator system is interpreted as having switched to the operating mode 20 (preparing to stop, high speed), in which the elevator is being stopped from a fast speed, for example, because of a fault situation. If the elevator car is moving upwards or its speed when moving downwards is at the highest $v_{lim1}$, it is checked whether information about the positioning of the elevator car in the door zone has been received from the elevator. If the door zone information indicates that the elevator car is in the door zone, operating mode 40 'car at door zone' is set. If the elevator car is not in the door zone, it is determined that the elevator system has switched to the operating mode 30, in which the elevator is being stopped from a slow speed (preparing to stop, low speed).

When the elevator system is in the operating mode 20, (elevator preparing to stop, high speed), the circumstance can be, for example, a situation in which the elevator car is being stopped by means of ETSL. The objective is in this case to stop the elevator by using different stopping appliances such that the elevator car is brought to a stop reliably and quickly. It is not desirable, however, that the stopping appliance used is switched on when the elevator is at full speed unless this is unavoidable, but rather the stopping appliance is activated only if and when the other safety systems and stopping appliances incorporated in the elevator system do not produce sufficient deceleration for the elevator car. Especially in fast elevators without a counterweight it is not desirable that the elevator car ends up being stopped, for example, by the safety gear when its speed is too great, because deceleration that is too great causes a risk to both the wellbeing of the passengers and to the operation of the stopping appliance itself.

The safety arrangement is thus applicable for use as additional safety as a supplement to prior art safety devices. It is however possible that other safety devices are replaced with the solution according to the invention.

The limit values set for the operating mode 20 set the limit for the minimum deceleration that the elevator car must have. Preferably the limit values are defined as a function of time, for example, in the manner described in FIG. 3. When the elevator system switches to mode 20, the moment of time when the switching occurs as well as the speed of the elevator car at the moment of switching is recorded in the memory. After this the deceleration of the elevator car is calculated as a function of time and it is monitored that the requirements set by the limit value for movement of the elevator car are fulfilled. Here the range of permitted movement is an area above the limit value, in which the deceleration exceeds the limit $g_{lim}(t)$, and the $g_{lim}(t)$ on the curve and the area below it, in which the deceleration is $g_{lim}(t)$ or less than it, causes activation of the stopping appliance.

Figure 3:
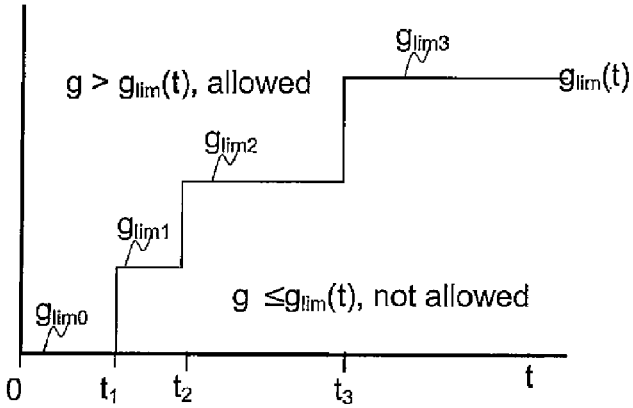
FIG. 3 presents some limit values of permitted movement according to the invention, which set the limit for the deceleration of the elevator car.

In FIG. 3 the moment t=0 describes the moment when the elevator system has switched to the operating mode 20. Between $t=0 \ldots t_1$ the limit value $g_{lim0}$ set for deceleration is zero, because deceleration is not needed just when the elevator system has switched to the operating mode 20. Between $t_1 \ldots t_2$ deceleration has the limit value $g_{lim1}$, between $t_2 \ldots t_3$ the limit value of deceleration is $g_{lim2}$ and after the moment $t_3$ the limit value is $g_{lim3}$. Preferably $g_{lim3}>g_{lim2}>g_{lim1}>g_{lim0}$ qualify for limit values, in which case it is possible to give other safety devices, such as to the machinery brake, time to stop the movement of the elevator car in a controlled manner, and to use the stopping appliance of the safety arrangement according to the invention only in fault situations of other systems or, for example, when the ropes slip in conjunction with an emergency stop. In elevators that move slowly, for example, 0.6 m/s, success of an emergency stop could be ensured by using a simple time delay, after which the stopping appliance is activated. Purely using a time delay in activating the stopping appliance would not however produce the desired result in fast elevators (speed, for example, 6 m/s) without a counterweight, because with prior art stopping appliances a time of some seconds is spent on stopping the movement of the elevator car, and the time delay could not be set large enough to prevent the speed of the elevator car from growing excessively, if, for example, the machinery brake is defective. With a deceleration limit value defined to grow as a function of time it is possible to ensure a safe emergency stop of the elevator car.

In mode 20 the speed and the direction of the elevator car are constantly monitored and compared to the speed limit $v_{lim1}$. In this mode, the limit values for speed and deceleration are set only for movement directed downwards, but it is possible to set limits for upwards movement. If the speed decreases below the value $v_{lim1}$ with sufficient deceleration, it is checked whether the elevator car is in the door zone, and depending on the door zone information the elevator system is determined to be either in the operating mode 30 or in the operating mode 40.

When movement of the elevator car occurs upwards or if the speed downwards is small, below $v_{lim1}$, there is a switch to mode 30 (elevator preparing to stop, low speed), in which the speed of the elevator car is monitored by comparing it to the limit value that sets the speed limit. The limit value $v_{lim2}$ of the greatest permitted speed connected to the operating mode 30 sets the speed limit below which the state of movement of the elevator is permitted at lower speeds. When the speed is $v_{lim2}$ or greater than this, the stopping appliance is activated. In addition, the velocity and the door zone information of the elevator car are monitored for setting the switching to the next operating mode. When the elevator system is in the operating mode 30, what is occurring can be, for example, a fault situation, in which the electricity supply of the elevator system is defective, and the speed of the elevator is restricted, for example, by means of dynamic braking of the motor, or for example, in the final stage of ETSL stopping. Further, it is possible that what is occurring is an emergency stop in upwards movement, which in an elevator without counterweight is, in itself, easy to implement when gravity is pulling the elevator car downwards, but in which there can be a risk of the brake slipping after the emergency stop. In mode 30 the safety arrangement ensures that the brake does not start to slip downwards after a successful emergency stop. Thus in the operating mode 30 of the elevator system according to the invention, the stopping appliance is activated if the speed of the elevator car exceeds the permitted limit, for example, when dynamic braking does not succeed, or if the ropes of the elevator slip—i.e. the friction between the traction sheave and the hoisting roping is not sufficient to keep the elevator on the desired path.

When the elevator is verified as having moved to the door zone, i.e. into operating mode 40 (car at door zone), comparison of the movement of the elevator car to both the speed limit and the position limits is started. In the door zone it is ensured that the speed of the elevator car is not able, for example, owing to rope slip or failure of the brakes, to exceed the permitted speed. It is further monitored in the door zone that the elevator car stays in the door zone, or that it leaves the door zone by at the most the permitted distance. The distance can be calculated when the information about the moment when the elevator car leaves the door zone is recorded, and the speed of the elevator car is constantly monitored. In the example according to FIG. 2, the speed of the elevator car is compared to the same limit values irrespective of whether the doors of the elevator car are open or closed, and whether the elevator is on the inching drive setting or not. According to the invention it is possible, however, that separate operating modes are set for these. Thus, three limit values of movement are connected to the operating mode 40: the limit value $v_{lim2}$ sets the speed limit, below which the state of movement of the elevator is permitted at lower speeds, and the limit values $h_{lim1}$ and $h_{lim2}$ set the limit for the permitted distance of the elevator car from the door zone. The permitted position h is between these, i.e. when $h_{lim1} \leq h \leq h_{lim2}$.

FIG. 2 depicts the safety arrangement especially of an elevator system without a counterweight, in which uncontrolled accelerating movement can only occur downwards. When using the solution according to the invention in an elevator system with a counterweight, in which a fault situation can cause uncontrolled movement of the elevator car either downwards or upwards depending on the state of loading of the elevator car, the criteria for making a decision about switching from one operating mode to another and/or setting the operating modes of the elevator system in the safety arrangement are preferably formed such that the speed and the deceleration are monitored and limit values are set for movement directed both upwards and downwards. It is possible that the limit values are set to be the same for the magnitudes directed upwards and directed downwards, but these can also differ from each other.

FIG. 2 depicts the operation of an elevator system according to the invention and of its safety arrangement with the aid of a simple embodiment. The safety arrangement according to the invention can however comprise means for setting other operating modes of the elevator system. In one preferred embodiment the safety arrangement comprises means for receiving information about the manual opening of the machinery brake, and in this case the machinery brakes can be opened manually such that the safety arrangement does not activate the stopping appliance, in which case the elevator car can drive to a floor when the electrical circuits are disconnected. The safety arrangement can further comprise means for testing the operation of the control switch of the stopping appliance and for resetting the memory of a safety device, for example, after malfunctioning of the elevator system. In one preferred embodiment the operation of the control switch of the stopping appliance is tested at regular intervals, for example, once a day or after the 50th run.

The means for receiving information and for monitoring movement that are incorporated in the arrangement according to the invention can be implemented with a software program in conjunction with the control system of the elevator such that for implementing the safety arrangement mainly a switch must be added to the elevator control system according to prior art for an elevator system, with which switch the stopping appliance can be activated when the output of the control means so sets it. A prior art stopping appliance can be used as a stopping appliance, which is fitted to operate also when controlled by a safety device other than one according to the invention, for example, a safety gear functioning as the stopping appliance of a mechanical overspeed governor.

By means of the solution presented in FIG. 2 it is possible to implement at least the following safety procedures: when the elevator car is situated in the door zone either in normal mode or in inching mode, the stopping appliance is activated if the elevator car moves away from the proximity of the door area or if the speed of the elevator car is too great. The stopping appliance is activated in an emergency stop downwards if the deceleration is not adequate, and in an emergency stop upwards if the speed of the elevator car after stopping tries to increase above the permitted limit. If the electricity of the elevator is disconnected during a run, it is attempted to stop or limit movement of the elevator car with the safety devices, and the stopping appliance of the solution is activated only if needed when the deceleration remains too small.

By means of the safety arrangement according to the invention it is also possible to implement the following functions: the means for controlling the stopping appliance can be fitted to switch off when the machinery brake is opened manually, in which case when the elevator car comes to a standstill outside the door area it can be driven away without the stopping appliance of the safety arrangement stopping the elevator car. In order to implement this, a switch can be fitted in connection with the machinery brake, which indicates the manual opening of the brake, and the safety arrangement can comprise means for receiving information about the status of this switch. The safety arrangement can also be fitted to enable manual rescue both during an electricity power cut and also when electricity is available.

It is obvious to the person skilled in the art that the invention is not limited solely to the example described above, but that it may be varied within the scope of the claims presented below. It is also obvious to a person skilled in the art that the functional parts of the aforementioned safety arrangement do not necessarily need to be separate but they can be integrated directly into the control system of the elevator. The limit values of permitted movement connected to the different operating modes can be stored in the memory of the means incorporated in the safety arrangement. In one preferred embodiment, the safety arrangement according to the invention is implemented in connection with the control unit of the frequency converter incorporated in the electricity supply equipment of the elevator, which in the prior art is fitted to receive information, which is used in the safety arrangement to set the operating mode of the elevator system. In this case no additional components at all are necessarily needed alongside the prior art safety devices to implement the safety appliance according to the invention, and the physical additional components needed can be restricted to, for example, a relay, with which the stopping appliance can be activated.

The invention is not limited to the embodiments described above, in which the invention is described using examples, but rather many adaptations and different embodiments of the invention are possible within the scope of the inventive concept defined by the claims presented below.

The invention claimed is:

1. A method for ensuring safety in an elevator system, the method comprising:

setting a first speed limit;

measuring a speed of an elevator car;

entering a first operating mode when the measured speed is greater than the first speed limit, wherein the first operating mode comprises:

setting a limit value for a rate of deceleration;

calculating elapsed time since entering the first operating mode;

measuring the rate of deceleration; and applying a brake if the measured rate of deceleration is below the limit value for the rate of deceleration;

determining if the elevator car is within a door zone when the measured speed is less than the first speed limit;

entering a second operating mode when the elevator car is not within a door zone and entering a third operating mode when the elevator car is within a door zone, wherein the second operating mode comprises:

comparing the speed of the elevator car to a second speed limit; and applying the brake if the speed of the elevator car exceeds the second speed limit; and wherein the third operating mode comprises:

comparing the speed of the elevator car to a third speed limit;

setting a first and second limit value for a distance of the elevator car to a door zone;

comparing a distance of the elevator car to a door zone to the first and second limit value for a distance of the elevator car to a door zone; and applying the brake if the speed of the elevator car exceeds the third speed limit or if a position of the elevator car is between the first and second limit value for a distance of the elevator car to a door zone.

2. The method of claim 1, further comprising increasing the limit value for the rate of deceleration as the elapsed time increases.

3. The method of claim 1, wherein setting a speed limit value comprises setting a first value for upward movement of the elevator car and setting a second value for downward movement of the elevator car.

4. The method of claim 1, further comprising receiving information about a direction of movement of the elevator car.

5. The method of claim 1, further comprising receiving information about a status of a safety circuit of the elevator car.

* * * * *